US010232412B2

(12) United States Patent
Milligan et al.

(10) Patent No.: US 10,232,412 B2
(45) Date of Patent: Mar. 19, 2019

(54) FLEXIBLE PARTS FIXTURING FOR AUTOMATED PARTS WASHING

(71) Applicant: Woodward, Inc., Fort Collins, CO (US)

(72) Inventors: Shannon P. Milligan, Rockford, IL (US); Mark E. McGinty, Brodhead, WI (US)

(73) Assignee: Woodward, Inc., Fort Collins, CO (US)

( * ) Notice: Subject to any disclaimer, the term of this patent is extended or adjusted under 35 U.S.C. 154(b) by 886 days.

(21) Appl. No.: 14/597,033

(22) Filed: Jan. 14, 2015

(65) Prior Publication Data

US 2016/0199891 A1 Jul. 14, 2016

(51) Int. Cl.

*B08B 13/00* (2006.01)
*B08B 3/04* (2006.01)
*B08B 11/02* (2006.01)

(52) U.S. Cl.

CPC ..... *B08B 3/045* (2013.01); *B08B 3/04* (2013.01); *B08B 11/02* (2013.01); *B08B 13/00* (2013.01)

(58) Field of Classification Search

CPC ..... B08B 3/045; B08B 3/04; B08B 3/047; B08B 11/00; B08B 11/02; B08B 13/00
USPC ..... 220/507
See application file for complete search history.

(56) References Cited

U.S. PATENT DOCUMENTS 4,830,200 A * 5/1989 Zambano ..... A47L 15/505 211/133.5
6,941,703 B2 * 9/2005 MacLean ..... A01K 1/0103 137/312

FOREIGN PATENT DOCUMENTS

DE 20215085 U1 2/2004
EP 2364929 A1 9/2011

OTHER PUBLICATIONS

PCT International Search Report and Written Opinion of the International Searching Authority, PCT/US2016/013354, dated Mar. 24, 2016, 13 pages.

* cited by examiner

*Primary Examiner* — Steven A. Reynolds
*Assistant Examiner* — Javier A Pagan
(74) *Attorney, Agent, or Firm* — Fish & Richardson P.C.

(57) ABSTRACT

The subject matter of this specification can be embodied in, among other things, a parts holder assembly that includes a basket having a basket floor and one or more posts each attached to the basket floor at a proximal post end and extending away from the basket floor at a distal post end, a retaining device having a frame having an open interior frame space, one or more mounting devices, each of the mounting devices being adapted to constrain the frame at a selected position along a length of a corresponding one of the posts between the proximal post end and the selected position, and a web having at least one outer edge attached to the frame and a plurality of cords extending across the open interior frame space.

11 Claims, 4 Drawing Sheets

FLEXIBLE PARTS FIXTURING FOR AUTOMATED PARTS WASHING

TECHNICAL FIELD

This instant specification relates to part-holding fixtures for automated machine parts washers.

BACKGROUND

In some manufacturing environments, washing of parts is done manually in wash cabinets. An operator sets a part in the wash unit and then manipulates it during the process to expose all sides of the part as it is washed. The part is generally not held or fixtured by any mechanical means during the manual wash process, nor is it captured for the subsequent oven drying process. This manual parts washing and drying process is very labor intensive and time consuming.

In some manufacturing environments, automated washing equipment is used. Such machines can wash and dry the parts in about a quarter of the time needed for manual washing, with human interaction generally only being needed for loading and unloading the washer. Some parts washer manufacturers provide stainless steel mesh baskets that are precisely sized to slide in and out of a washer carriage and stay captured with little movement. Some of these baskets have a compression lid that can be lowered onto parts and locked in place to contain them. The parts can move around in the baskets, and the baskets are metal, so they may damage parts made of softer materials (e.g., aluminum). Baskets made from a plastic or resin material are available to reduce part damage, however they are typically more heavily reinforced, which can inhibit fluid and air flow.

Some automated parts washers rotate the parts during the wash cycle while high pressure and/or high flow jets blast water over and throughout the parts' cavities and features. The parts are also rotated during ultrasonic wash and heated blow-off drying cycles. All of this rotation coupled with the washing and drying forces acting on the parts can also cause the washed parts to move during the process. Movement of the parts can result in damage to the parts, the washer, or both, as a loose parts could become jammed in the washer's rotation mechanism.

Some automated parts washers utilize part holders (jigs) that are custom-made to secure selected parts for washing. Such custom solutions are best suited for production environments that utilize a high-volume, low-mix production model. However, high-mix production environments, low-volume or otherwise, many of such custom part holders may be needed, which increases manufacturing tooling costs, changeover times, and space required to store the holders.

SUMMARY

In general, this document describes part-holding fixtures for automated machine parts washers.

In a first aspect, a parts holder assembly includes a basket having a basket floor with a plurality of openings therethrough and one or more posts each attached to the basket floor at a proximal post end and extending away from the basket floor at a distal post end, a retaining device having a frame having a frame outer width, a frame outer length, a frame inner width less than the frame outer width, a frame inner length less than the frame outer length, the frame inner length and the frame inner width defining an open interior frame space, one or more mounting devices, each of the mounting devices being adapted to constrain the frame at a selected position along a length of a corresponding one of the posts between the proximal post end and the selected position, and a web having at least one outer edge attached to the frame and a plurality of cords extending across the open interior frame space.

Various embodiments can include some, all, or none of the following features. The retaining device can also include a tray having a tray floor with a plurality of openings formed therethrough and a first hinge section adjacent to a first tray floor edge, a second hinge section adjacent to a first retaining device outer edge, adapted to mate with the first hinge section and pivotably attach the retaining device to the first tray floor edge, and a latch assembly adapted to releasably constrain pivotal movement of the retaining device to a latching height away from the tray floor. The tray can also include a removable peg board having a peg board length less than the frame inner length, a peg board width less than the frame inner width, and a peg board thickness greater than the latching height, and having a plurality of peg mounting points arranged upon a face of the peg board, a plurality of openings formed therethrough between the peg mounting points, and a plurality of pegs, each peg attached to a corresponding one of the peg mounting points at a proximal peg end and extending away from the peg board at a distal peg end. The cords can be spaced apart in a known arrangement of the cords and open spaces, and the one or more of the peg mounting points can be spaced apart in an arrangement reflective of the arrangement of open spaces such that the pegs extend through the open spaces and between the cords when the peg board is inserted onto the tray floor and the retaining device is at the latching height. At least one of the pegs can be adapted to be removably retained by the corresponding one of the peg mounting points at the proximal peg end. The basket and the retaining device can have an overall width, an overall length, and an overall height equal to or less than those of a parts washing basket for an identified automated parts washer, and the basket and the retaining device can be adapted for use in place of the parts washing basket. The retaining device can be flexible such that a first one of the mounting devices can be constrained at a first distance away from the basket floor along the length of a corresponding first one of the posts, and a second one of the mounting devices can be constrained at a second distance different from the first distance away from the basket floor along the length of a corresponding second one of the posts. The basket can be lined with a chemical-resistant polypropylene mesh. The parts holder can also include one or more spacers adapted for constraint of a corresponding one of the mounting points to a minimum distance away from the basket floor along the length of a corresponding one of the posts. One or more of the cords can be elastic. One of more of the mounting devices can be a collar configured to be releasably attached to a corresponding one of the posts at the selected position.

In a second aspect, a method of using a parts holder assembly includes providing a basket comprising a basket floor having a plurality of openings therethrough and one or more posts each attached to the basket floor at a proximal post end and extending away from the basket floor at a distal post end, placing a part to be washed onto the basket floor, providing a retaining device comprising a frame having a frame outer width, a frame outer length, a frame inner width less than the frame outer width, a frame inner length less than the frame outer length, the frame inner length and the frame inner width defining an open interior frame space, one or more mounting devices, each of the mounting devices being adapted to constrain the frame at a selected position along a length of a corresponding one of the posts between the proximal post end and the selected position, and a web having at least one outer edge attached to the frame and a plurality of cords extending across the open interior frame space, positioning the retaining device at the selected position such that the part is constrained between the web and the basket floor, and constraining, using one or more of the mounting devices, the frame at the selected position.

Various implementations can include some, all, or none of the following features. The retaining device can be flexible and the method can also include constraining a first one of the mounting devices at a first selected position at a first distance away from the basket floor along the length of a corresponding first one of the posts, and constraining a second one of the mounting devices at second selected position at a second distance different from the first distance away from the basket floor along the length of a second one of the posts, such that the frame flexes between the first mounting device and the second mounting device. The basket can be lined with a chemical-resistant polypropylene mesh. The method can also include providing one or more spacers adapted for constraint of a corresponding one of the mounting points to a minimum distance away from the basket floor along the length of a corresponding one of the posts. One or more of the cords can be elastic, and the selected position can space the retaining device such that the part is constrained between the basket floor and one or more stretched cords. One of more of the mounting devices can include a collar, and constraining the frame at the selected position can include releasably attaching the collar to a corresponding one of the posts such that the frame is constrained at the selected position.

In a third aspect, a method of using a parts holder assembly includes providing a basket comprising a basket floor having a plurality of openings therethrough and one or more posts each attached to the basket floor at a proximal post end and extending away from the basket floor at a distal post end, providing a tray assembly having a tray floor having a plurality of openings formed therethrough, a first hinge section adjacent to a first tray floor edge, and one or more mounting devices, each of the mounting devices being adapted to constrain the tray assembly at a selected position along a length of a corresponding one of the posts between the proximal post end and the selected position. The method also includes constraining, using one or more of the mounting devices, the tray assembly at the selected position, placing a part to be washed onto the tray floor, and providing a retaining device having a frame with a frame outer width, a frame outer length, a frame inner width less than the frame outer width, a frame inner length less than the frame outer length, the frame inner length and the frame inner width defining an open interior frame space, a second hinge section adjacent to a first retaining device outer edge, adapted to mate with the first hinge section and pivotably attach the retaining device to the first tray floor edge, a web having at least one outer edge attached to the frame and a plurality of cords extending across the open interior frame space, and a latch assembly adapted to releasably constrain pivotal movement of the retaining device to a latching height away from the tray floor. The method also includes pivoting the frame about the first hinge section and the second hinge section to the latching height such that the part is constrained between the web and the tray floor.

Various implementations can include some, all, or none of the following features. The method can also include providing a removable peg board having a peg board length less than the frame inner length, a peg board width less than the frame inner width, and a peg board thickness greater than the latching height, a plurality of peg mounting points arranged upon a face of the peg board, a plurality of openings formed therethrough between the peg mounting points, and attaching one or more pegs to a corresponding one of the peg mounting points at a proximal peg end and extending away from the peg board at a distal peg end, wherein placing a part to be washed onto the tray floor includes placing the part on the peg board. The cords can be spaced apart in a known arrangement of the cords and open spaces, the one or more of the peg mounting points can be spaced apart in an arrangement reflective of the arrangement of open spaces, and pivoting the frame about the first hinge section and the second hinge section to the latching height further comprises pivoting the frame about the first hinge section and the second hinge section such that the pegs extend through the open spaces and between the cords when the peg board is inserted onto the tray floor and the retaining device is at the latching height. Attaching one or more pegs to a corresponding one of the peg mounting points at a proximal peg end and extending away from the peg board at a distal peg end can include removably retaining the pegs, wherein at least one of the pegs can be adapted to be removably retained by the corresponding one of the peg mounting points at the proximal peg end. The method can also include inserting the basket, the tray assembly, and the retaining device into a space adapted for a parts washing basket within an automated parts washer, wherein the basket, the tray, and the retaining device can be adapted for use in place of the parts washing basket. Constraining, using one or more of the mounting devices, the tray assembly at the selected position can include providing one or more spacers adapted for constraint of a corresponding one of the mounting points to a minimum distance away from the basket floor along the length of a corresponding one of the posts, and constraining the tray assembly along the length of the posts between the mounting devices and the spacers.

The systems and techniques described here may provide one or more of the following advantages. First, a fixture can provide secure retention of any part that can fit within the work envelope of a selected automated parts washer. Second, the fixture can be used in place of the wash basket that is provided and used with automated parts washers. Third, the fixture can reduce tooling costs and changeover times, especially in high mix, low volume production environments.

The details of one or more implementations are set forth in the accompanying drawings and the description below. Other features and advantages will be apparent from the description and drawings, and from the claims.

DETAILED DESCRIPTION

This document describes fixtures and techniques for automated machine parts washing. In general, automated parts washers include a mesh basket, a cage, or other container in which parts can be placed and through which wash solution (e.g., water) can be sprayed. Some automated parts washers rotate the basket during the wash and drying cycles, and such rotation coupled with the washing and drying forces acting on the parts can cause the parts to move, potentially damaging each other and/or the washer.

In general, this document describes fixtures that can be used in place of the wash basket typically provided and used with automated parts washers. The fixtures are generally configured to securely ensnare parts to be washed between a generally non-compliant floor and a compliant surface (e.g., elastic netting) that can be movably mounted at a user-selectable distance from the floor, stretching the compliant surface over the part. An example of a lidded tray with an optional peg board fixture for holding smaller parts in an automated parts washer is also described.

Such parts washing fixtures are particularly adaptable to high mix, low volume production environments, which means that a large variety of parts may be washed in the area. In some embodiments, such parts can range in size from about the volume of a deck of cards up to about the volume of a 5-gallon bucket, and can have very irregular shapes and protrusions. Parts to be washed may not typically include flat mounting surfaces or threaded holes to attach to, and common features may be nearly nonexistent. Also, such parts may have critical features with tight tolerances and strict surface finishes that are to be kept free of nicks, dings, and UVC's (Unusual Visual Conditions) while also getting thoroughly cleaned. Without the flexible fixtures described in this document, such environments may stock a large number of unique and dedicated fixtures which can be costly and space-consuming.

Figure 1:
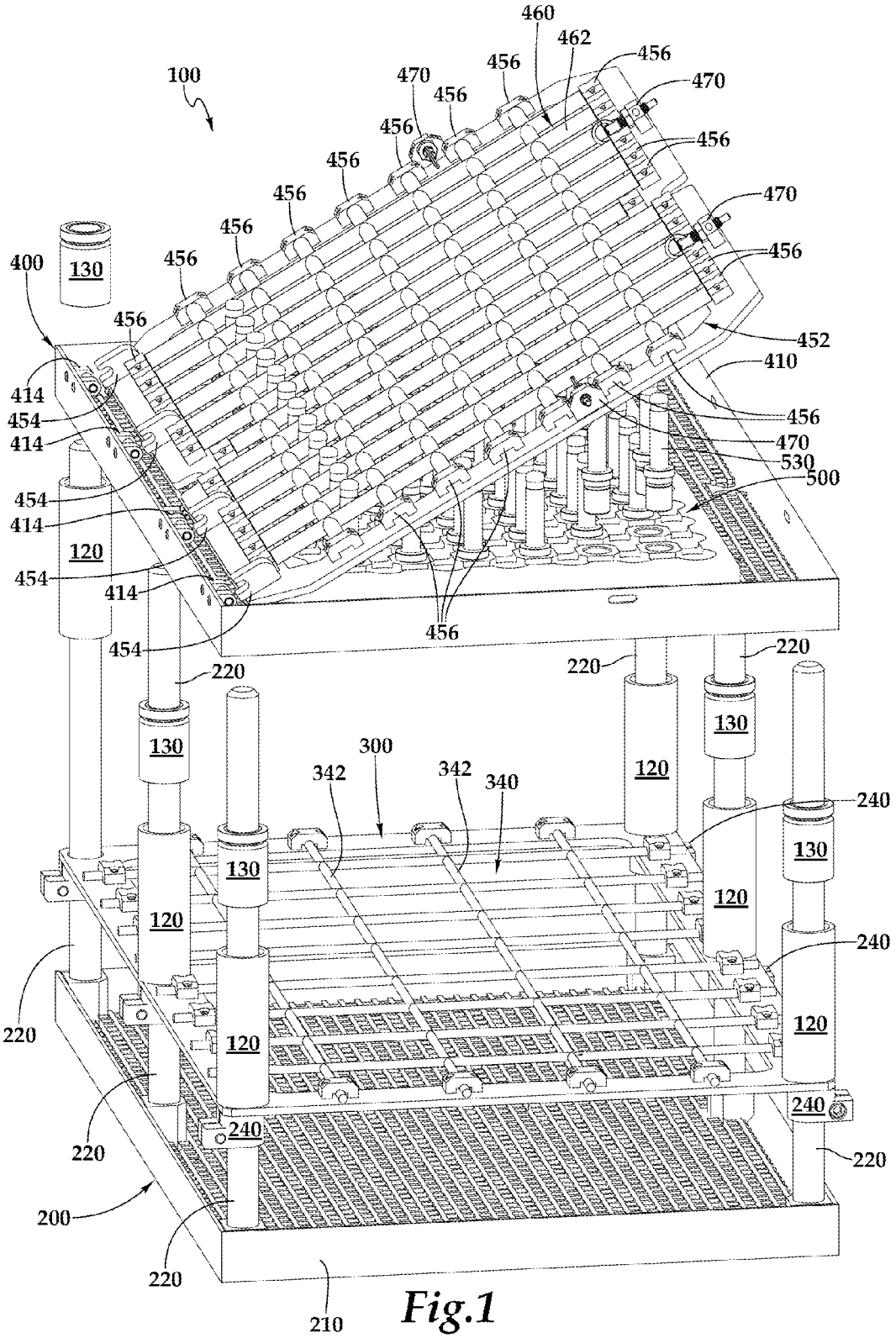
FIG. 1 is a perspective view of an example of an example fixture for automated parts washing.

FIG. 1 is a perspective, partly exploded view of an example fixture 100 for automated parts washing. The fixture 100 includes a base 200, which includes a basket 210 and a collection of posts 220. A retainer device 300 is spaced apart from the basket 210 a selected distance along the posts 220 by a collection of clamps 240. In use, a part to be washed can be placed upon the base 200, and the retainer device 300 can be moved along the posts 220 until the retainer device 300 contacts the part to be washed, compressively holding the part between the base 200 and the retaining device 300. The retaining device 300 can then be removably fixed in this compressive position by the clamps 240 and/or a collection of quick-release collars 130 that are manually fixable and moveable along the posts 220. The base 200, the posts 220, the clamps 240, the quick-release collars 130, and the retainer device 300 are described further in the discussion of FIGS. 2, 3, and 7.

The example fixture 100 also includes a tray assembly 400. The tray assembly 400 is spaced apart from the retainer device 300 by a selected distance along the posts 220 by a collection of spacers 120. In the illustrated example, the spacers 120 are cylinders having a predetermined length and a diameter that allows them to slip over the posts 220. A removable peg board 500 is insertable into the tray assembly 400. The tray assembly 400 and the peg board 500 are described further in the discussion of FIGS. 4-6. In some embodiments, the tray assembly 400 may be used with base 200 and the posts 220, omitting the retainer device 300. For example, the tray assembly 400 may be spaced apart from the basket 210 by the spacers 120 and/or the clamps 240.

The tray assembly 400 of example fixture 100 is removably secured at the selected position by the collection of quick-release collars 130 that are manually fixable and moveable along the posts 220. The collars 130 can be formed as cylinders with bores though which the posts 220 can pass. In some embodiments, each of the quick-release collars 130 can include a button, ring, or other mechanism that an operator can manually actuate to release and/or secure the quick-release collars 130 at selected positions along the lengths of the posts 220. In some embodiments, the quick-release collars 130 may be replaced by clamps or other assemblies (e.g., collars with set screws, pins through bores in the posts) that can be adjustably mounted along the lengths of the posts 220.

In some embodiments, the materials used in the example fixture 100 may be chosen based on their resistance to conditions inside an automated parts washer. For example, temperatures in the wash and rinse water can reach 140 F and heated air used for drying can reach temperatures of up to 220 F. In another example, the chemistry in the wash tank can be maintained at about 3% to 5%, or about 4% concentration which can result in an alkaline pH of 7.5-8.5. Materials in the example fixture 100 may be chosen to resist these temperature and chemistry conditions.

Figure 2:
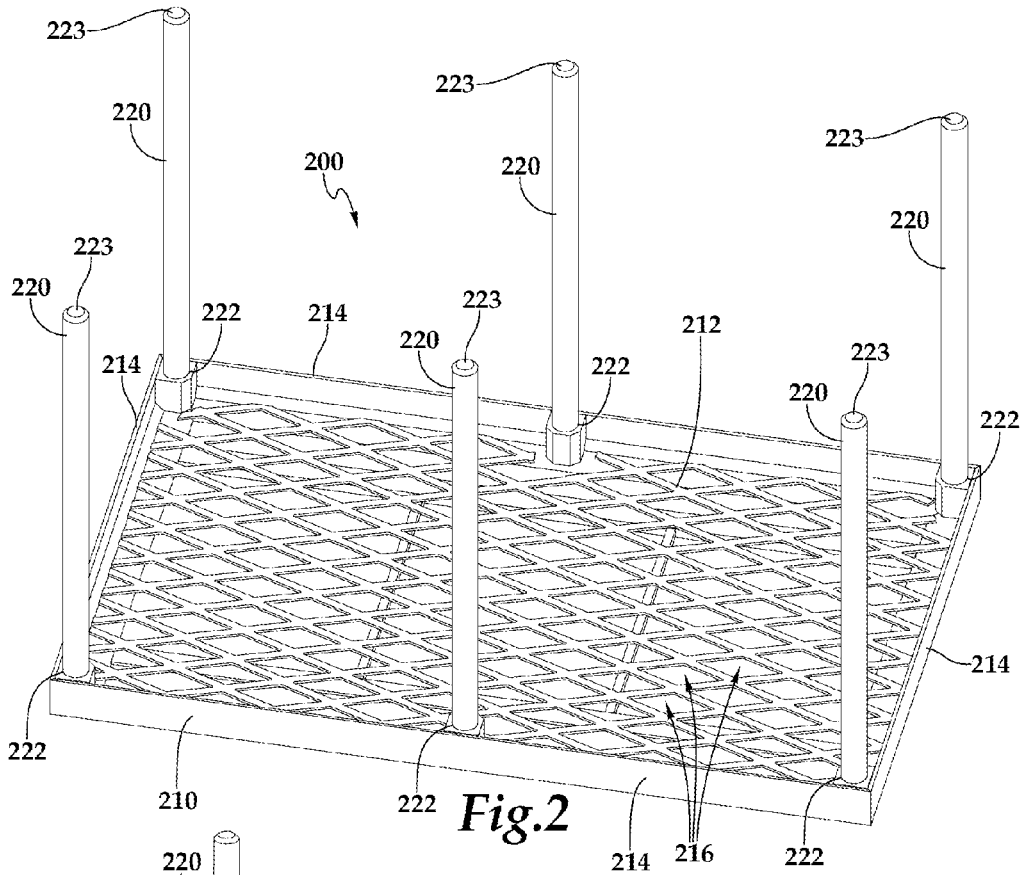
FIG. 2 is a perspective view of an example base for an example fixture for automated parts washing.

FIG. 2 is a perspective view of the example base 200 of the example fixture 100 of FIG. 1. The base 200 includes the basket 210, and the collection of posts 220. As shown, each of the posts 220 is coupled to the basket 210 at a proximal end 222 and extends away from the basket 210 at a distal end 223, with each of the posts 220 being substantially parallel to each other.

The basket 210 shown in FIG. 2 includes a floor 212 and a collection of side walls 214 extending substantially perpendicular to the plane of the floor 212. The floor 212 includes a collection of openings 216 through which water, air, and other fluids may pass (e.g., cleaning and drying agents). In some embodiments, the floor 212 may be made of metal (e.g., expanded metal grating), plastic, composite materials (e.g., carbon fiber), or any other appropriate material. In some embodiments, a layer of mesh (e.g., a screen) may be layered adjacent to the floor 212. For example, a layer of screen material may be placed in the basket 210 to protect the parts from the material of the floor 212 and/or to prevent small parts being washed from falling through the openings 216, while still allowing cleaning fluids and air to pass.

Figure 3:
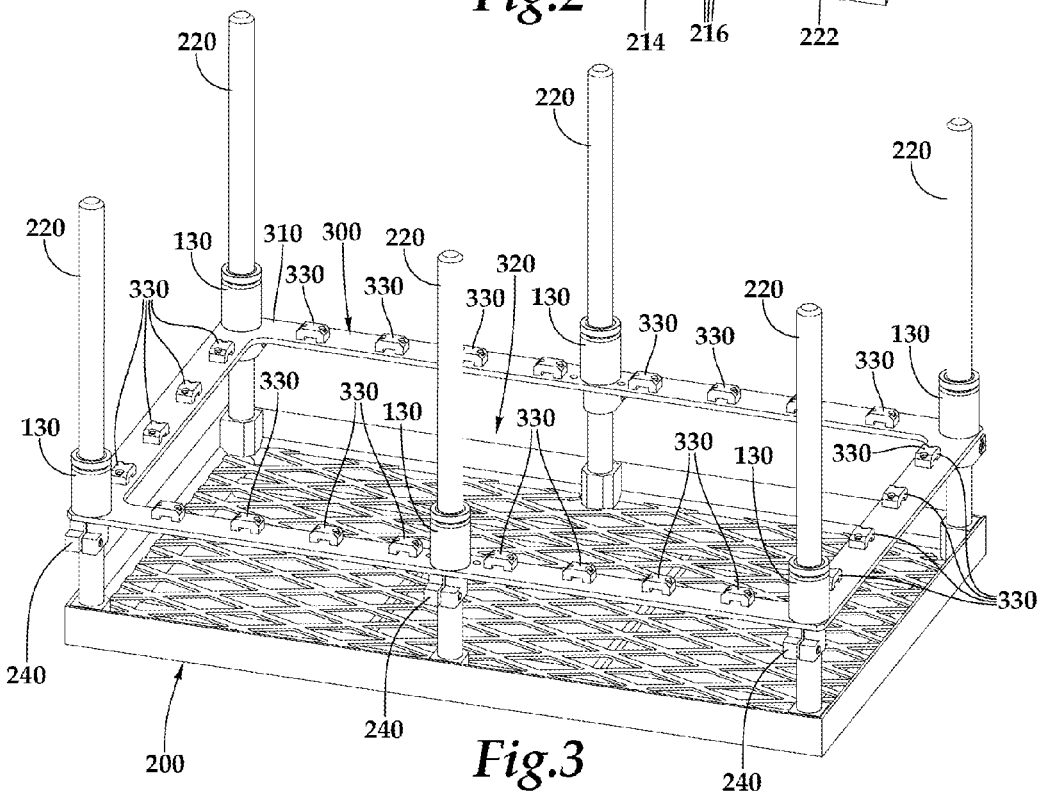
FIG. 3 is a perspective view of an example base 200 and retainer device 300 of an example fixture for automated parts washing.

FIG. 3 is a perspective view of an example base 200 and retainer device 300 of the example fixture 100 of FIG. 1. The retainer device 300 includes a frame 310 having an outer width and outer length, an inner width less than the outer width, and an inner length less than the outer length. The inner length and inner width define an open interior frame space 320.

The retainer device 300 shown in FIG. 3 also includes a collection of clamps 330 arranged about the periphery of the frame 310. The clamps 330 are configured to retain a web 340, not shown in this view. Referring back to FIG. 1, the outer edges of the web 340 are attached to the frame 310, and the web 340 includes a plurality of cords 342 extending across the open interior frame space 320. The cords 342 are spaced apart with a density that retains parts to be washed while allowing air, water, and cleaning fluids to pass through the interior frame space 320. In some embodiments, the cords 342 can be formed of an elastic or otherwise extensible, compliant material (e.g., a web of 0.250" to 0.375" pre-tensioned latex rubber cords) that is stretched across the open interior frame space 320. In some embodiments, the cords 342 can be formed of a substantially inelastic or otherwise non-extensible, compliant material (e.g., rope, cable) that extends across the open interior frame space 320. In some embodiments, the cords 342 can intersect (e.g., molded together as a grid), while in some embodiments the cords 342 can form a weave (e.g., intersecting but interwoven with each cord 342 going over another cord 342 and under the next).

Referring once again to FIG. 3, the retainer device 300 is mounted to the posts 220. In the illustrated example, the posts 220 are passed through a collection of apertures (not visible) formed through the frame 310. The retainer device 300 can be adjustably mounted at any distance from the basket 210 along the lengths of the posts 220. The retainer device 300 can be retained at an adjustable minimum distance apart from the basket 210 by the collection of clamps 240. The clamps 240 can be adjustably mounted at any position along the lengths of the posts 220. The retainer device 300 is prevented from moving further than a maximum distance apart from the basket 210 by the collection of quick-release collars 130. The quick-release collars 130 can be adjustably mounted at any distance from the basket 210 along the lengths of the posts 220.

In use, and as will be discussed further in the description of FIG. 7, one or more parts to be washed can be placed in the basket 210. The parts are supported on the bottom by the floor 212, and at least partly retained within the basket laterally by the side walls 214. The retainer device 300 is mounted upon and is slid down over the posts 220 to bring the web 340 into contact with the parts to be washed (e.g., to vertically retain the parts to be washed). The retainer device 300 is then held in position by the collection of clamps 240 and the collection of quick-release collars 130. For example, the clamps 240 can hold the retainer device 300 at a minimum distance from the basket 210, and/or the quick-release collars 130 can hold the retainer device 300 at a maximum distance from the basket 210. The quick-release collars 130 can be individually slid onto each of the posts 220 and pushed down to apply pressure to the frame 310. The quick-release collars 130 are self-locking, e.g., they will not move on the post 220 or release pressure on the frame 310 until the operator pulls the release feature on each collar. In some embodiments, the clamps 240 may be omitted. For example, the retainer device 300 may be spaced apart from the basket 210 by the quick-release collars, and contact between the web 340 and the parts to be washed can provide the force that retains the retainer device 300 at a distance apart from the basket 210.

Figure 4:
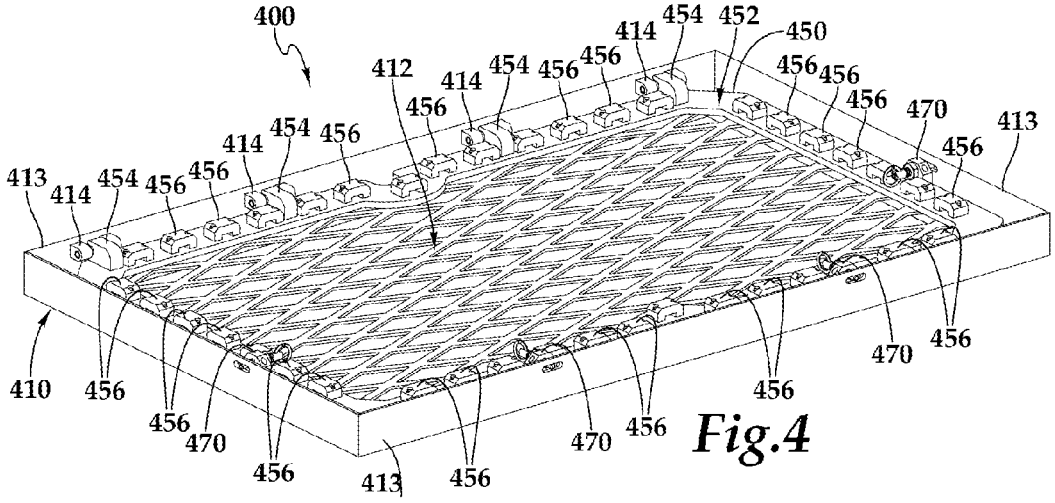
FIG. 4 is a perspective view of an example hinged tray for an example fixture for automated parts washing.

FIG. 4 is a perspective view of an example tray assembly 400 for the example fixture 100 of FIG. 1. In general, the tray assembly 400 is configured to hold parts to be washed that are too small to be retained adequately by a combination of the retainer device 300 and the base 200. For example, the retainer device 300 and the base 200 may not provide enough holding force to retain medium-sized, small-sized, and/or relatively flat parts to be washed in embodiments in which the frame 310 and the cords 342 cannot be stretched far enough down and around the parts to be washed. To remedy this, a variation of the main fixture was developed to sandwich parts using the tray assembly 400, which implements a hinged clamshell type of design.

The example tray assembly 400 includes a tray 410 having a tray floor 412, a collection of side walls 413 extending substantially perpendicular to the plane of the tray floor 412, and a collection of hinge portions 414. The tray floor 412 includes a collection of openings through which water, air, and cleaning fluids may flow. In some embodiments, the tray floor 412 may be made of metal, plastic, composite materials (e.g., carbon fiber), or any other appropriate material. In some embodiments, a layer of mesh (e.g., a screen) may be layered adjacent to the tray floor 412. For example, a layer of screen material may be placed in the basket assembly to prevent small parts to be washed from falling through the openings and/or to protect the parts from damage from contact with the tray floor 412 while still allowing cleaning fluids and air to pass.

The example tray assembly 400 also includes a frame 450 having an open interior frame space 452. The frame 450 includes a collection of hinge portions 454 arranged along one edge of the frame 450. The hinge portions 454 are configured to mate with the hinge portions 414 such that the frame 450 can pivot relative to the tray 410 on a hinge formed by the hinge portions 414 and 454. A collection of latch assemblies 470 on the frame 450 releasably engage the side walls 413 to constrain pivotal movement of the frame 450 relative to the tray floor 412 (e.g., to retain the frame 450 at a latching height away from the tray floor 412).

Referring back to FIG. 1, which shows the frame 450 pivoted into an open or unlatched configuration relative to the tray 410, the frame 450 also includes a collection of clamps 456 arranged about the periphery of the frame 450. The clamps 456 are configured to retain a web 460. The outer edges of the web 460 are attached to the frame 450 and a plurality of cords 462 extending across the open interior frame space 452. The cords 462 are spaced apart with a density that retains parts to be washed while allowing air, water, and cleaning fluids to pass through the interior frame space 452. In some embodiments, the cords 462 can be formed of an elastic or otherwise extensible, compliant material (e.g., a web of 3/80.250" to 0.375" pre-tensioned latex rubber cords) that is stretched across the open interior frame space 452. In some embodiments, the cords 462 can be formed of a substantially inelastic or otherwise non-extensible, compliant material (e.g., rope, cable) that extends across the open interior frame space 452. In some embodiments, the cords 462 can intersect (e.g., molded together as a grid), while in some embodiments the cords 342 can form a weave (e.g., intersecting but interwoven with each cord 462 going over another cord 462 and under the next).

Still referring to FIG. 1, the example tray assembly 400 can be adjustably mounted on the posts 220 by using a combination of the clamps 240, the spacers 120, and/or the quick-release collars 130. In some embodiments, more than one of the tray assemblies 400 can be mounted at the same time on the posts 220 at different distances from the base 200 (e.g., held apart by the spacers 120).

In use, the frame 450 can be pivoted open, and relatively small parts (e.g., parts too small to be retained by the retainer device 300 and the base 200) can be placed in the tray 410. The frame 450 can be closed and latched to retain the parts between the tray floor 412 and the web 460 for washing.

Figure 5:
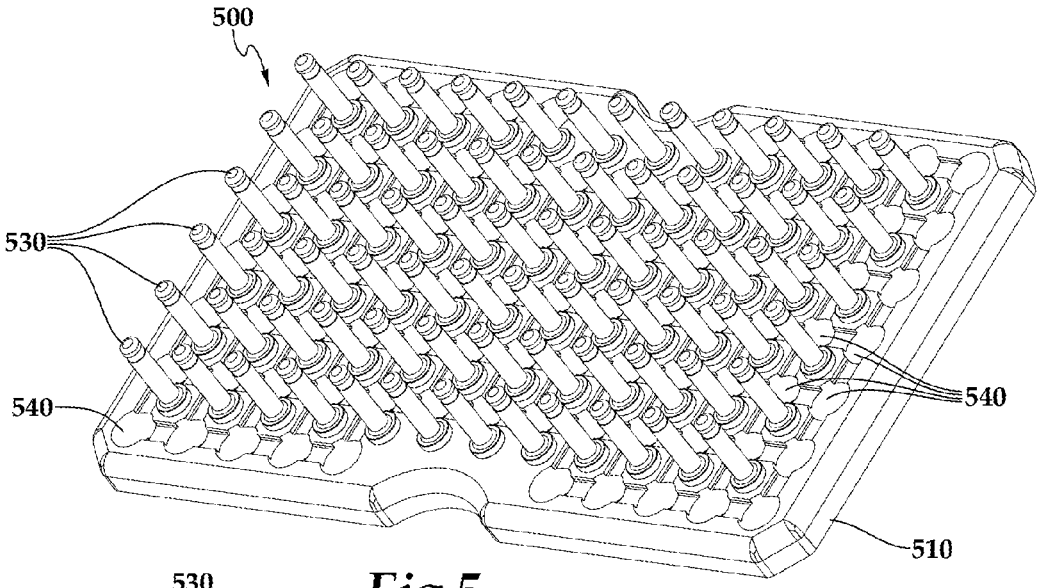
FIGS. 5 and 6 are perspective and partial sectional side views of an example peg board for an example fixture for automated parts washing.
Figure 6:
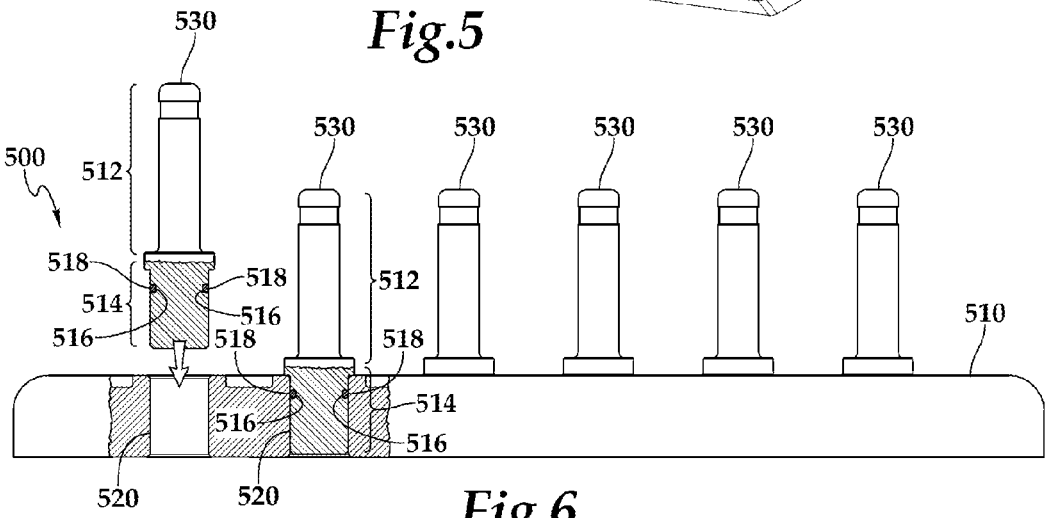

FIGS. 5 and 6 are perspective and partial sectional side views of the example peg board 500 of the example fixture 100 of FIG. 1. In some implementations, the smallest parts that are to be washed in the fixture 100 may be small enough to move (e.g., slide) within the tray assembly 400 due to rotation, spray, and/or blow off forces of the wash process.

To remedy this, the peg board 500 may be used as an insert that fits into the tray assembly 400 to provide lateral and/or additional compressive capturing. The peg board 500 includes base 510. In some embodiments, the base 510 can have a length and width less than that of the tray 410 of FIG. 4, such that the base 510 can fit within the sidewalls 413. In some embodiments, the base 510 can have a length and width less than that of the frame 450, such that the base 510 can fit within the frame space 452 such that the web 460 can be at least partly pre-tensioned over the peg board 500 when the frame 450 is at the latching height.

The peg board 500 includes a collection of sockets 520 (shown in FIG. 6) into which a collection of pegs 530 are inserted, and a collection of openings 540 (shown in FIG. 5) through which fluids such as water, air, and cleaning fluids can pass. Each of the pegs 530 includes an upper section 512 and a lower section 514. The lower section 514 includes a channel 516 in which an o-ring 518 or other compliant member is held. The o-ring 518 provides a friction fit that removably retains the lower section 514 in the socket 520. In some embodiments, the lower sections 514 and the sockets 520 may be otherwise configured to releasably retain the pegs 530 to the base 510. For example, the pegs 530 may be retained in the sockets 520 by magnets, the pegs 530 and the sockets 520 may be threaded for screw-in mounting or may be channeled for press-and-turn mounting, or the pegs 530 and the sockets 520 may be configured with any other appropriate retention features. The sockets 520 are distributed in a configuration that approximates that of the spaces between the cords 462 in the web 460 of FIG. 1. For example, the sockets 520 can be arranged such that the pegs 530 can extend through the web 460 at locations where the web 460 is proximate to the peg board 500, as shown in FIG. 1.

In some implementations, the peg board 500 can be used to retain and/or separate small parts to be washed. For example, the peg board 500 can be inserted into the tray 410 of FIG. 4. Parts to be washed can be placed on the base 510, and the pegs 530 can be inserted into the sockets 520 substantially adjacent to the parts to be washed. The frame 450 can be pivoted to the latched (e.g., closed) position, in which the pegs 530 extend through the openings between the cords 462 of the web 460, and the cords 462 are brought into contact or near-contact with the base 510 between the pegs 530. As such, the parts to be washed can be retained and/or separated by a combination of the base 510, the web 460, and the pegs 530. In some embodiments, the base 510 can be thicker than the latching height of the frame 450, such that the web 460 is at least partly pre-tensioned across the peg board 500 when the frame 450 is closed to the latching height.

Figure 7:
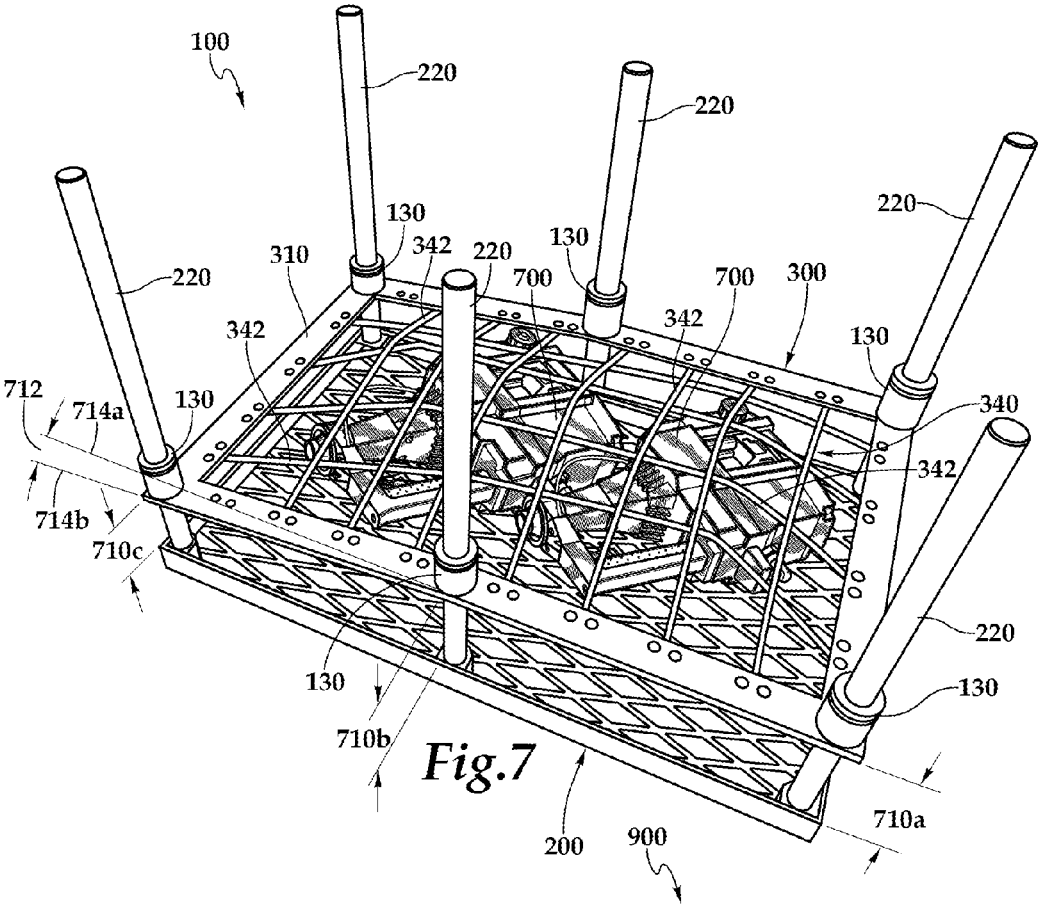
FIG. 7 is a perspective view of an example fixture holding example parts for automated parts washing.

FIG. 7 is a perspective view of the example fixture 100 holding example parts 700 for automated parts washing. The parts 700 are placed in the base 200, and then the retainer device 300 is placed on the posts 220. The retainer device 300 is slid along the lengths of the posts 220 to bring the web 340 into at least partial contact with the parts 700. The quick-connect collars 130 are placed on the posts 220 and slid along the lengths of the posts 200 to bring the quick-connect collars 130 into contact with the retainer device 300 on the side opposite the parts 700. The retainer device 300 is reversibly held in tension with the parts 700 by the quick-connect collars 130.

The frame 310 of the example fixture 100 shown in FIG. 7 is flexible in order to further retain the parts 700. In the illustrated example, three of the quick-connect collars 130 are mounted on the posts 200 at a height 710*a*, a height 710*b*, and a height 710*c*. The height 710*a* and the height 710*b* are substantially the same height away from the base 200, while the height 710*c* is relatively closer to the base 200 along the post 220. The frame 310 flexes to allow these different heights 710*a*-710*c*, as represented by the angle 712 which is the angle difference between a line 714*a* representing a line passing through the height 710*a* and the height 710*b*, and a line 714*b* representing a line passing through the height 710*b* and the height 710*c*.

Due to the individual adjustability of the quick-release collars 130, the fixture can form fit to oddly shaped parts to be washed, both through flexing of the frame 310 and stretch of the web 340. The cords of the web 340 are woven together so when a protruding part feature or corner is exposed, it can become laterally and vertically locked into the web 340.

Figure 8:
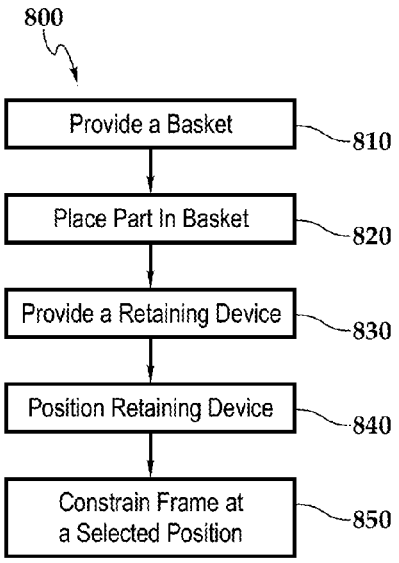
FIGS. 8 and 9 are flow diagrams for example processes for using an example fixture for automated parts washing.

FIG. 8 is a flow diagram for an example process 800 for using the example fixture 100 of FIG. 1 for automated parts washing. At step 810, a basket is provided. The basket includes a basket floor having a collection of openings therethrough, and one or more posts each attached to the basket floor at a proximal post end and extending away from the basket floor at a distal post end. For example, the base 200 includes the basket 210 and the floor 212 with the collection of openings 216 therethrough. The posts 220 extend upward from the basket 210. In some embodiments, the basket floor can be lined with a chemical-resistant and/or heat-resistant polypropylene mesh.

At 820, a part to be washed is placed onto the basket floor. For example, the part 700 of FIG. 7 can be placed on the floor 212.

At 830, a retaining device is provided. The retaining device includes a frame having a frame outer width, a frame outer length, a frame inner width less than the frame outer width, a frame inner length less than the frame outer length, the frame inner length and the frame inner width defining an open interior frame space. The frame also includes one or more mounting devices, each of the mounting devices being adapted to constrain the frame at a selected position along a length of a corresponding one of the posts between the proximal post end and the selected position. The frame also includes a web having at least one outer edge attached to the frame and a plurality of cords extending across the open interior frame space. For example, the retainer device 300 defines the interior frame space 320, and the web 340 extends across the interior frame space 320. The collection of quick-release collars 130 are provided to be slipped over the posts 220 to constrain the retainer device 300 at a selected adjustable height.

At 840, the retaining device is positioned at the selected position such that the part is constrained between the web and the basket floor. For example, the retainer device 300 is positioned to constrain the parts 700 between the web 340 and the basket 210. In some embodiments, one or more of the cords may be elastic, and the selected position positions the retaining device such that the part is constrained between the basket floor and one or more stretched cords. In some implementations, one or more spacers or clamps may be provided to constrain corresponding ones of the mounting points to a minimum distance away from the basket floor along the length of a corresponding one of the posts. For example, the spacers 120 and/or the clamps 240 may be placed on the posts 220 before the retainer device 300, and the retainer device 300 may rest upon the spacers 120 to maintain a predetermined distance apart from the basket 210.

At 850 the frame is constrained at the selected position using one or more of the mounting devices. For example, the quick-release collars 130 constrain the retainer device 300 at the selected position apart from the basket 210. In some embodiments, one or more of the quick-release collars 130 may be formed as a collar adapted to fit about one of the posts 220, and constraining the frame 310 at the selected position may also include releasably attaching the collar to a corresponding one of the posts 220 such that the frame 310 is constrained at the selected position.

In some implementations, the process 800 can also include constraining a first one of the mounting devices at a first selected position at a first distance away from the basket floor along the length of a corresponding first one of the posts, and constraining a second one of the mounting devices at second selected position at a second distance different from the first distance away from the basket floor along the length of a second one of the posts, such that the frame flexes between the first mounting device and the second mounting device. For example, the frame 310 can be flexible, and can be secured by the quick-release collars 130 at the heights 710*a*-710*c* which can cause the frame 310 to flex at the angle 712.

Figure 9:
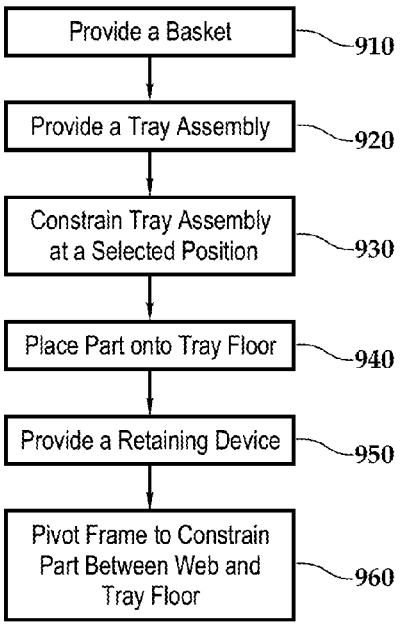

FIG. 9 is a flow diagram for another example process 900 for using an example fixture for automated parts washing. At 910 a basket is provided. The basket includes a basket floor having a plurality of openings therethrough, and one or more posts each attached to the basket floor at a proximal post end and extending away from the basket floor at a distal post end. For example, the base 200 includes the basket 210 and the floor 212 with the collection of openings 216 therethrough. The posts 220 extend upward from the basket 210. In some implementations, the basket floor can be lined with a chemical-resistant and/or heat-resistant polypropylene mesh.

At 920, a tray assembly is provided. The tray assembly includes a tray floor having a plurality of openings formed therethrough, a first hinge section adjacent to a first tray floor edge, and one or more mounting devices, each of the mounting devices being adapted to constrain the tray assembly at a selected position along a length of a corresponding one of the posts between the proximal post end and the selected position. For example, the tray assembly 400 and the quick-release collars 130 of FIGS. 1 and 4 can be provided.

At 930 the tray assembly can be constrained to the selected position by using one or more of the mounting devices. For example, the quick-release collars 130 can be adjustably mounted on the posts 220 to limit how far the tray assembly 400 can be moved along the posts 220 away from the basket 210.

In some implementations, constraining the tray assembly at the selected position can also include providing one or more spacers or clamps adapted for constraint of a corresponding one of the mounting points to a minimum distance away from the basket floor along the length of a corresponding one of the posts, and constraining the tray assembly along the length of the posts between the mounting devices and the spacers. For example, the spacers 120 and/or the clamps 240 may be placed on the posts 220 before the tray assembly 400, and the tray assembly 400 may rest upon the spacers 120 to maintain a predetermined minimum distance from the basket 210.

At 940 a part to be washed is placed onto the tray floor. For example, a part may be placed on the tray floor 412.

At 950, a retaining device is provided. The retaining device includes a frame having a frame outer width, a frame outer length, a frame inner width less than the frame outer width, a frame inner length less than the frame outer length, the frame inner length and the frame inner width defining an open interior frame space, a second hinge section adjacent to a first retaining device outer edge, adapted to mate with the first hinge section and pivotably attach the retaining device to the first tray floor edge, a web having at least one outer edge attached to the frame and a plurality of cords extending across the open interior frame space, and a latch assembly adapted to releasably constrain pivotal movement of the retaining device to a latching height away from the tray floor. For example, the frame 450 can be provided.

At 960, the frame is pivoted about the first hinge section and the second hinge section to the latching height such that the part is constrained between the web and the tray floor. For example, the frame 450 can be pivoted on the hinge portions 414 and 454 to close the tray assembly 400 and hold parts to be washed between the tray floor 412 and the web 460.

In some implementations a removable peg board may be provided. The peg board can have a board length less than the frame inner length, a peg board width less than the frame inner width, and a peg board thickness greater than the latching height, a plurality of peg mounting points arranged upon a face of the peg board, a plurality of openings formed therethrough between the peg mounting points. For example, the base 510 of the peg board 500 of FIGS. 1, 5, and 6, can be provided. In some implementations, the process 900 can include attaching one or more pegs to a corresponding one of the peg mounting points at a proximal peg end and extending away from the peg board at a distal peg end. For example, the pegs 530 can be inserted into the sockets 520. In some implementations, placing a part to be washed onto the tray floor and can include placing the part on the peg board. For example, small parts can be placed on the base 510 between the pegs 530.

In some implementations, attaching one or more pegs to a corresponding one of the peg mounting points at a proximal peg end and extending away from the peg board at a distal peg end further can include removably retaining the pegs, and at least one of the pegs can be adapted to be removably retained by the corresponding one of the peg mounting points at the proximal peg end. For example, the pegs 530 can be inserted and removed from the sockets 520, and the pegs 530 can be removably held in place by friction between the o-rings 518 and the walls of the sockets 520.

In some implementations, the cords may be spaced apart in a known arrangement of the cords and open spaces, and one or more of the peg mounting points can be spaced apart in an arrangement reflective of the arrangement of open spaces, and pivoting the frame about the first hinge section and the second hinge section to the latching height can also include pivoting the frame about the first hinge section and the second hinge section such that the pegs extend through the open spaces and between the cords when the peg board is inserted onto the tray floor and the retaining device is at the latching height. For example, as can be seen best in FIG. 1, the peg board 500 is oriented such that the pegs can extend through the spaces between the cords 462.

In some implementations, the process 900 can include inserting the basket, the tray assembly, and the retaining device into a space adapted for a parts washing basket within an automated parts washer, wherein the basket, the tray, and the retaining device are adapted for use in place of the parts washing basket. For example, the fixture 100 can be sized to fit within the space normally occupied by an original equipment manufacturer (OEM) parts washing basket typically provided with a commercial parts washing machine. The fixture 100 can include mounting features that at least partly replicate those of the OEM basket that are used to secure the OEM basket within the automatic parts washer during the wash process. In some embodiments, the fixture 100 can include such mounting features on the base 200 such that the fixture 100 can be secured within the automated parts washer without needing to affix the posts 220, the retainer device 300, or the tray assembly 400 directly to the automated parts washer. In some embodiments, the fixture 100 can include such mounting features along the posts 220. For example, the clamps 240 can provide mounting features that can removably secure the fixture 100 within the automated parts washer. In some embodiments, the clamps 240 may be repositioned along the posts 220 to adapt the fixture 100 to emulate the mounting features of differently configured parts washing baskets, such as the parts washing baskets provided for use in other makes and/or models of automated parts washers.

Although a few implementations have been described in detail above, other modifications are possible. For example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A parts holder assembly comprising:

a basket comprising:

a substantially non-compliant basket floor having a plurality of openings therethrough;

a mesh layer, adjacent to the basket floor; and one or more posts each attached to the basket floor at a proximal post end and extending away from the basket floor at a distal post end;

a retaining device comprising:

a frame having a frame outer width, a frame outer length, a frame inner width less than the frame outer width, a frame inner length less than the frame outer length, the frame inner length and the frame inner width defining an open interior frame space;

one or more mounting devices, each of the mounting devices being adapted to constrain the frame at a selected position away from the basket floor and the mesh layer along a length of a corresponding one of the posts between the proximal post end and the selected position; and a web having at least one outer edge attached to the frame and a plurality of compliant elastic cords extending across the open interior frame space.

2. The parts holder assembly of claim 1, wherein the retaining device further comprises:

a tray comprising:

a tray floor having a plurality of openings formed therethrough; and a first hinge section adjacent to a first tray floor edge;

the retaining device further comprising:

a second hinge section adjacent to a first retaining device outer edge, adapted to mate with the first hinge section and pivotably attach the retaining device to the first tray floor edge; and a latch assembly adapted to releasably constrain pivotal movement of the retaining device to a latching height away from the tray floor.

3. The parts holder assembly of claim 2, wherein the tray further comprises:

a removable peg board having a peg board length less than the frame inner length, a peg board width less than the frame inner width, and a peg board thickness greater than the latching height, and comprising:

a plurality of peg mounting points arranged upon a face of the peg board;

a plurality of openings formed therethrough between the peg mounting points; and a plurality of pegs, each peg attached to a corresponding one of the peg mounting points at a proximal peg end and extending away from the peg board at a distal peg end.

4. The parts holder assembly of claim 3, wherein the cords are spaced apart in a known arrangement of the cords and open spaces, and the one or more of the peg mounting points are spaced apart in an arrangement reflective of the arrangement of open spaces such that the pegs extend through the open spaces and between the cords when the peg board is inserted onto the tray floor and the retaining device is at the latching height.

5. The parts holder assembly of claim 3, wherein at least one of the pegs is adapted to be removably retained by the corresponding one of the peg mounting points at the proximal peg end.

6. The parts holder of claim 1, wherein the basket and the retaining device have an overall width, an overall length, and an overall height equal to or less than those of a parts washing basket for an identified automated parts washer, and the basket and the retaining device are adapted for use in place of the parts washing basket.

7. The parts holder of claim 1, wherein the retaining device is flexible such that a first one of the mounting devices can be constrained at a first distance away from the basket floor along the length of a corresponding first one of the posts, and a second one of the mounting devices can be constrained at a second distance different from the first distance away from the basket floor along the length of a corresponding second one of the posts.

8. The parts holder of claim 1, wherein the basket is lined with a chemical-resistant polypropylene mesh.

9. The parts holder of claim 1, further comprising one or more spacers adapted for constraint of a corresponding one of the mounting points to a minimum distance away from the basket floor along the length of a corresponding one of the posts.

10. The parts holder of claim 1, wherein one of more of the mounting devices comprises a collar configured to be releasably attached to a corresponding one of the posts at the selected position.

11. The parts holder assembly of claim 1, wherein the basket further comprises a collection of side walls extending substantially perpendicular to the plane of the floor and configured to at least partly retain one or more parts within the basket.

* * * * *